US005371960A

United States Patent [19]

Wilson et al.

[11] Patent Number: 5,371,960

[45] Date of Patent: Dec. 13, 1994

[54] IRON INCLUDING CORD REEL AND WATER TANK

[75] Inventors: Ian G. Wilson, Cheltenham; Richard L. Hoare, Neutal Bay, both of Australia

[73] Assignee: Sunbeam Corporation Limited, Campsie, Australia

[21] Appl. No.: 970,620

[22] Filed: Nov. 3, 1992

[30] Foreign Application Priority Data

Nov. 8, 1991 [AU] Australia ..... PK9374

[51] Int. Cl.[5] ..... D06F 75/28

[52] U.S. Cl. ..... 38/77.3; 38/96; 219/256

[58] Field of Search ..... 38/75, 77.1, 77.3, 79, 38/88, 94; 219/246, 247, 256, 259; 242/47.5, 77, 78.7, 107.7

[56] References Cited

U.S. PATENT DOCUMENTS

| | | | |
|---|---|---|---|
| 2,063,274 | 12/1936 | Ehrlich | 219/256 X |
| 3,949,499 | 4/1976 | Schaeffer et al. | 38/77.3 |
| 4,347,428 | 8/1982 | Conrad et al. | 38/88 X |
| 4,517,757 | 5/1985 | Asada et al. | 38/88 |
| 4,784,616 | 11/1988 | Zimmermann | 219/247 X |

FOREIGN PATENT DOCUMENTS

| | | | |
|---|---|---|---|
| 0053254 | 6/1982 | European Pat. Off. . | |
| 2583792 | 12/1986 | France | 219/247 |
| 3825501 | 2/1990 | Germany . | |
| 3843384 | 7/1990 | Germany . | |
| 0212631 | 3/1941 | Switzerland | 38/77.3 |
| 2233986 | 1/1991 | United Kingdom . | |

*Primary Examiner*—Clifford D. Crowder
*Assistant Examiner*—Ismael Izaguirre
*Attorney, Agent, or Firm*—Ladas & Parry

[57] ABSTRACT

A garment iron including a rear face to which there is releasably attached a cord reel. The cord reel includes a catch to retain it in its position mounted on the rear face. The cord reel is hollow so as to provide a cavity which receives a beaker which may be used to deliver water to the water reservoir of the iron. During use, the cord reel and beaker are removed from the rear face so that the iron may be vertically oriented, resting on its rear face.

13 Claims, 5 Drawing Sheets

10
11
12
13
14
15
16
17
18
19
20
21
22
23
24
25
26
27
28
29
30
31
38

IRON INCLUDING CORD REEL AND WATER TANK

TECHNICAL FIELD

The present invention relates to a garment iron and more particularly to a reel to receive the electric cord of the iron.

BACKGROUND OF THE INVENTION

Electrically operated irons are provided with an electric cord to extend to a power outlet. It has been known to provide the rear end of irons with means about which the electric cord may be wound for storage purposes. However, this previously known means of storing the electric cord has not been successful as the cord in essence is not retained in a coiled configuration. There has also been the need to reduce the overall length of the iron in order to ensure stability of the iron when it rests on its rear face so as to have the hot plate generally upwardly extending. If the rear of the iron is extended to accommodate the cord, the iron becomes less stable due to its height when in the rest position.

Steam irons are provided with a resevoir into which water is delivered, which water is transformed into steam during the ironing process. Frequently new irons are sold with a beaker which may be used to deliver water to the water inlet of the iron. These beakers are not physically associated with the iron and accordingly become lost.

OBJECT OF THE INVENTION

It is the object of the present invention to overcome or substantially ameliorate the above disadvantages.

SUMMARY OF THE INVENTION

There is disclosed herein a garment iron comprising:

a main body providing a handle and being equipped with a soleplate, and electrically operated means to heat the soleplate, said body having a rear face with engagable means;

an electric cord extending from said body to connect said electrically operated means to an electric supply; and a cord reel about which said cord is wound, said reel having attachment means to releasably engage said engagable means to selectively secure said reel to said main body.

Preferably the reel is hollow so as to provide a cavity, and a beaker is shaped to be received within said cavity.

BRIEF DESCRIPTION OF THE DRAWINGS

A preferred form of the present invention will now be described by way of example with reference to the accompanying drawings wherein.

DESCRIPTION OF THE PREFERRED EMBODIMENT

Figure 1:
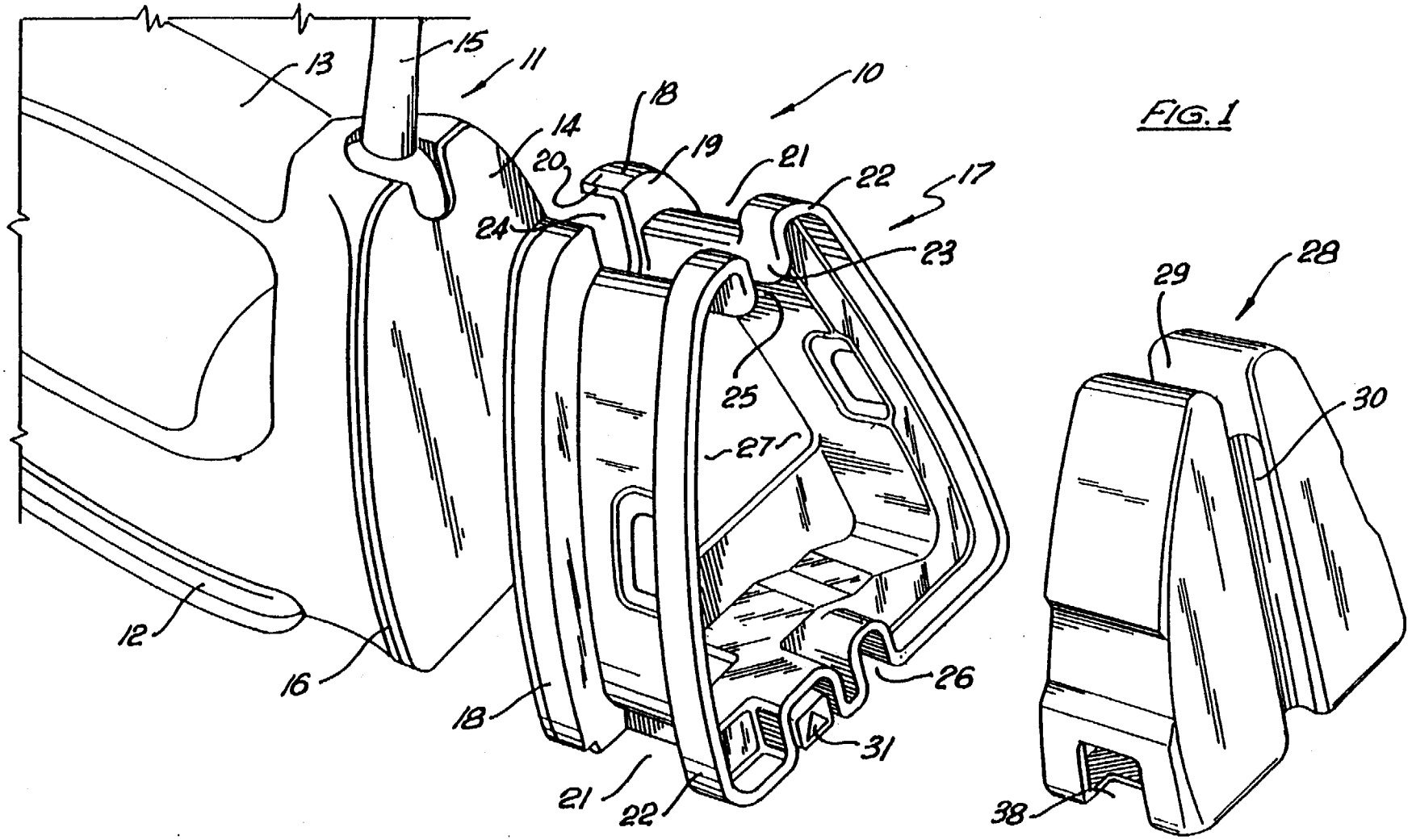
FIG. 1 is a schematic parts exploded perspective view of an iron incorporating a cord reel and beaker.
Figure 2:
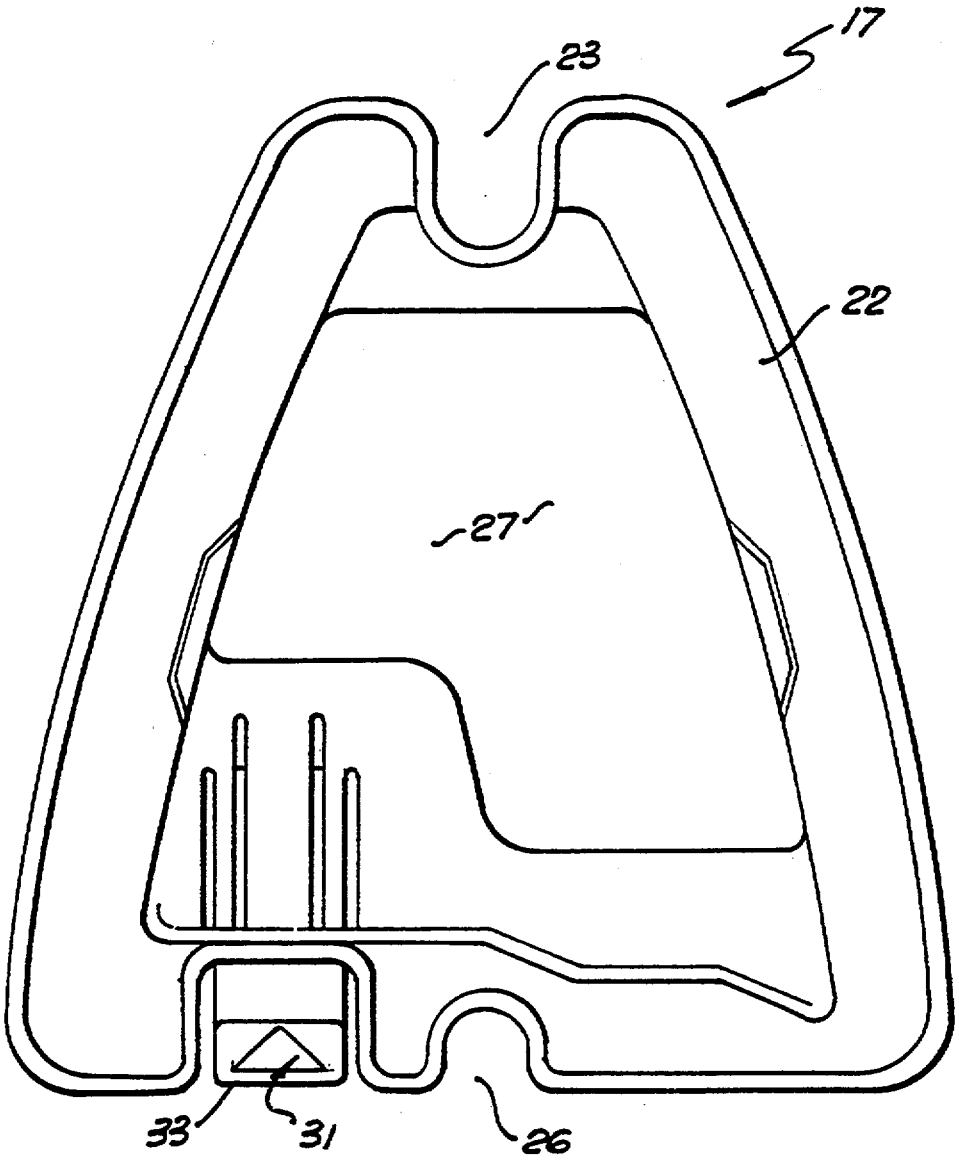
FIG. 2 is a schematic rear elevation of the reel of FIG. 1.
Figure 3:
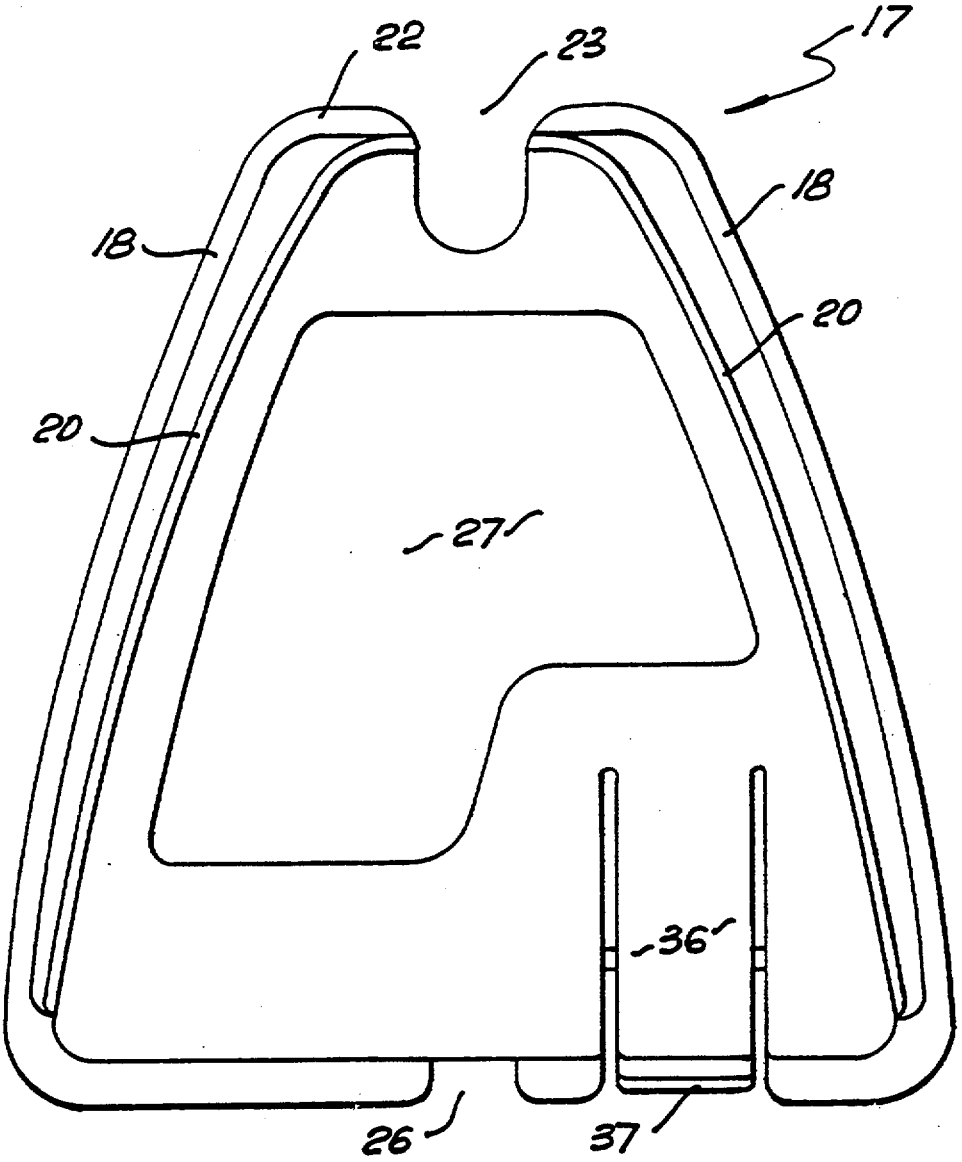
FIG. 3 is a schematic front elevation of the reel of FIG. 1.
Figure 4:
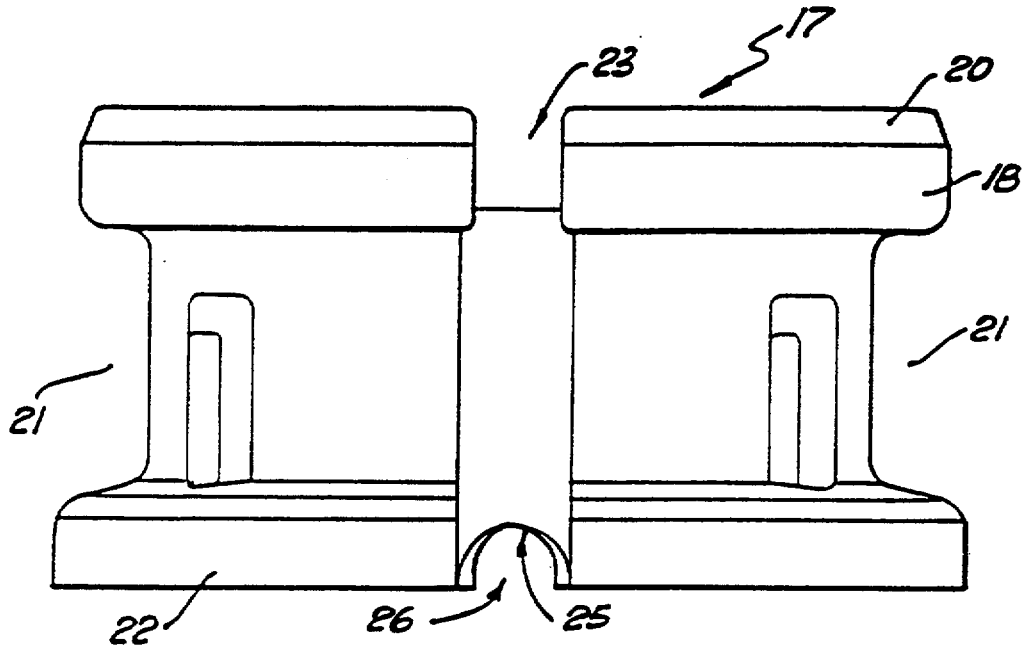
FIG. 4 is a schematic top plan view of the reel of FIG. 1.
Figure 5:
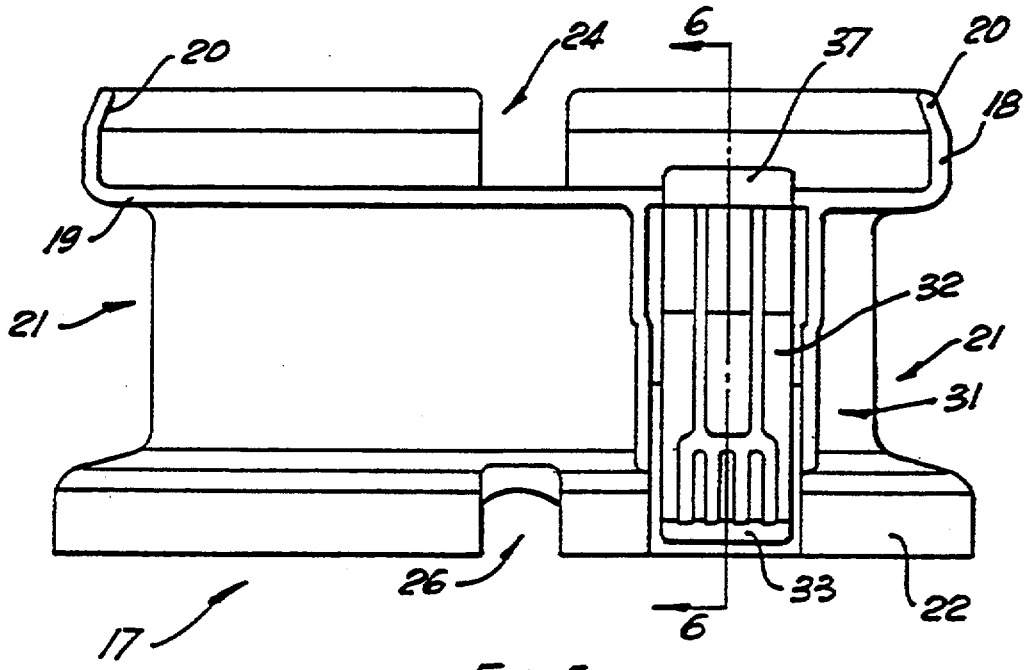
FIG. 5 is a schematic bottom plan view of the reel of FIG. 1.
Figure 6:
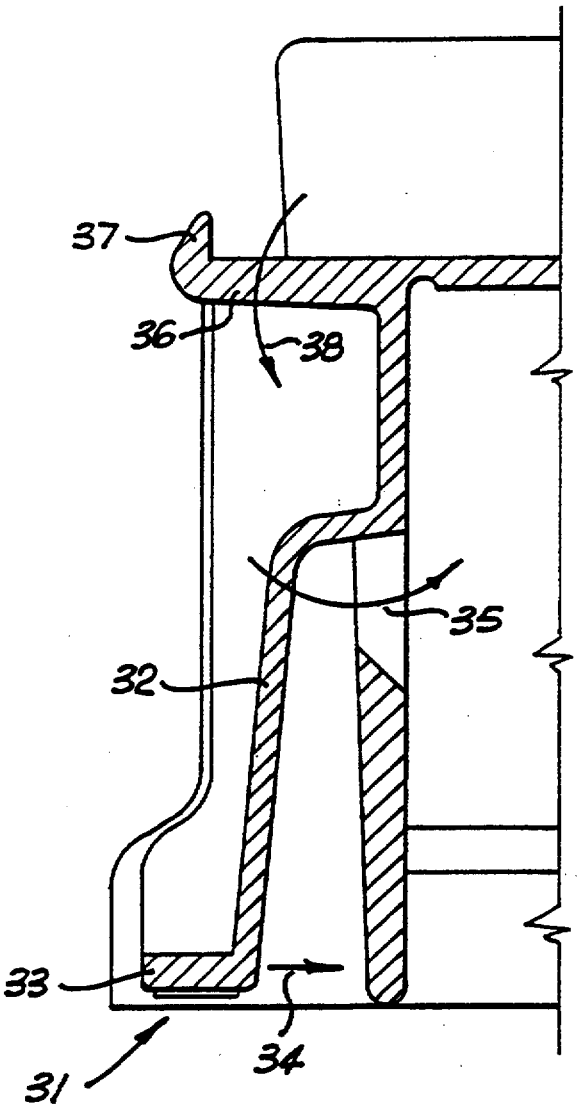
FIG. 6 is a schematic sectioned side elevation of the reel as illustrated in FIG. 5 sectioned along the line 6—6.

In the accompanying drawings there is schematically depicted an iron 10. The iron 10 includes a main body 11 provided with a soleplate 12 which is electrically heated. The body 11 is also provided with a handle 13 and a rear face 14. The soleplate 12 is connected to an electric cord 15, which connects the soleplate 12 to a supply of electricity.

Adjacent to the rear face 14 is a lip or flange 16, which provides an engagable means to be operatively associated with a cord reel 17. The cord reel 17 has a forward flange 18 of "L-shaped" configuration so as to have a base 19 and a forwardly projecting lip 20. The flange 20 extends down the left and right hand sides of the reel 17 and is adapted to engage the flange 16 so that the reel 17 can be mounted adjacent to the face 14. The flange 18 is particularly configured so that the reel 17 is coupled to the flange 16 by downward movement of the reel 17 over the rear face 14.

The reel 17 has a recess 21 which forms a loop and within which the cord 15 is wound. The rear of the reel 17 is also provided with a flange 22 so that the cord 15 has its loops sandwiched between the flanges 18 and 22.

The reel 17 is of a triangular configuration with its upper apex provided with a trough 23 having a forward aperture 24 which enables the cord 15 to enter the trough 23, and a rearward aperture 25 enabling the cord to extend downwardly from the trough 23 to a lower trough 26. The cord 15 passes through the trough 26 and then is wound around the reel 17 so that the loops are contained in the recess 21.

The reel 17 Is of a hollow configuration so as to provide a central chamber 27. Locatable within the chamber 27 is a beaker 28 which is of a complementary shape to the chamber 27 and includes a recess 29 into which the trough 23 projects, and a rear recess 30 down which the cord passes to enter the trough 26. The beaker 28 may be of a "dish" configuration so as to have an open face or alternatively may be provided with a filling neck equipped with a stopper. However the preferred construction of the beaker 28 has a filling aperture 38 which inhibits storage of the beaker 28 with water in it.

Preferably the beaker 28 can "snap" fit within the chamber 27.

To secure the reel 17 in position, there is provided a catch 31. The catch 31 is formed integral with the remainder of the reel 17 and includes a lever 32 terminating at one end with a finger grip portion 33. The finger grip portion is moved in the direction of the arrow 34 to cause pivoting of the lever 32 in the direction of the arrow 35. The forward end of the lever 32 is provided with a catch member 36 having a catch lip 37. Pivoting of the lever 32 in the direction of the arrow 35 causes pivoting of the catch member 36 in the direction of the arrow 38. The lip 37 engages a lower portion of the flange 16 or an abutment especially provided. When the reel 17 is moved down the flange 16, the lip 37 is resiliently deflected rearward until the reel 17 has reached its rest position. Thereafter, the lip 37;.moves into its clip engagement position. To release the reel 17, the user moves the finger grip portion 33 in the direction of the arrow 34. This then pivots the lip 37 from engagement and permits the reel 17 to be moved upward relative to the flange 16 until the flange 18 is disengaged therefrom. Preferably, the reel 17 is moulded of plastics material. The beaker 28 would be also moulded from plastics material.

The above described preferred embodiment has the advantage of providing a storage for the cord 15, which storage in use will not add to the overall length of the iron body 11 so that when the iron body 11 is resting on its rear face 14, the center of gravity of the iron body 11 is not too high. Normally in use, the reel 17 is removed together with the beaker 28. Accordingly the reel 17 is not intended to be a fixture in respect of the body 11. When the iron 10 is to be stored, the reel 17 is attached to the body 11.

What we claim is:

1. A garment iron comprising:

a main body having a handle and a soleplate, said body having a rear face provided with engageable means thereat, an electric cord extending from said body for connection with an electrical power supply to electrically heat said soleplate, and a cord reel releasably attached to said rear face of the body, said cord reel including a front flange engageable with said main body at said rear face thereof, and a resilient catch for releasably securing the cord reel to said rear face of the main body, said resilient catch comprising a lever having an end lip, said resilient catch having a rest position in which said lip engages said engageable means to secure the cord reel to said main body and a release position in which said lip is released from said engageable means and said cord reel is released from said main body.

2. The garment iron as claimed in claim 1, wherein said resilient catch comprises a pivotal lever integrally moulded in said cord reel.

3. The garment iron as claimed in claim 1, wherein said cord reel includes a rear flange spaced from said front flange and forming a recess therebetween in which said cord can be wound when the cord reel is engaged with said main body, said rear flange having top and bottom troughs in which the cord is passed before being wound in said recess.

4.The garment iron as claimed in claim 3, wherein said front flange of the cord reel has a trough through which said cord can pass to one of the troughs of the rear flange of the cord reel.

5. The garment iron as claimed in claim 1, wherein said cord reel has a central chamber accessible through a rear facing opening of said cord reel, said garment iron further comprising a beaker engageable in said central chamber.

6. The garment iron as claimed in claim 5, wherein said beaker and cord reel have means for providing a snap fit for said beaker in said chamber.

7. The garment iron as claimed in claim 5, wherein said resilient catch comprises a pivotal lever integrally moulded in said cord reel, said beaker having a groove which extends between said top and bottom troughs when the beaker is engaged in said chamber for passage of the cord in said groove between said troughs.

8. The garment iron as claimed in claim 5, wherein said beaker has a water cavity therein and a filling opening.

9. In a garment iron having a main body with an electrical power cord extending from said body, the improvement comprising a combination removable cord reel and beaker including, a reel member having a front face releasably engageable with a rear face of the main body, and a rear face spaced from said front face, said reel member having a central chamber open and accessible at said rear face of the reel member, and a beaker removably engageable in said chamber of the reel member, said reel member including flanges at said front and rear surfaces defining a recess therebetween in which the power cord of the main body can be wound around said chamber when the reel member is engaged with said main body.

10. The combination claimed in claim 9, wherein said rear flange of the reel member has two opposed troughs therein in which the cord is passed before being wound in said recess around said chamber.

11. The combination as claimed in claim 10, wherein said front flange of the reel member has a trough through which said cord can pass to one of the troughs in the rear flange of the reel member.

12. The combination as claimed in claim 9, wherein said reel member includes a releasable catch means for releasably engaging the main body.

13. The combination as claimed in claim 9, wherein said front flange of the reel member includes means for engaging the main body.

* * * * *